United States Patent [19]

Taniguchi et al.

[11] Patent Number: 5,076,586

[45] Date of Patent: Dec. 31, 1991

[54] 3-COURSE MINIATURE GOLF LINKS

[75] Inventors: Kyuhei Taniguchi; Hiroki Hashimoto; Ryoichi Suzuki, all of Tokyo, Japan

[73] Assignee: Fujita Corporation, Tokyo, Japan

[21] Appl. No.: 648,008

[22] Filed: Jan. 31, 1991

[30] Foreign Application Priority Data

Jan. 31, 1990 [JP] Japan ..... 2-18938

[51] Int. Cl.[5] ..... A63B 69/36

[52] U.S. Cl. ..... 273/176 AB; 273/178 B

[58] Field of Search ..... 273/176 A, 176 AB, 176 R, 273/176 B, 176 D, 176 E, 176 F, 176 FA, 176 AA, 176 FB, 176 G, 176 H, 176 K, 176 L, 35 B

[56] References Cited

U.S. PATENT DOCUMENTS

| | | | |
|---|---|---|---|
| 2,846,229 | 8/1958 | Morris | 273/176 AB |
| 3,156,470 | 11/1964 | Newkirk | 273/176 AB |
| 3,719,360 | 3/1973 | Purdy | 273/176 A |
| 4,157,831 | 6/1979 | Renn | 273/176 AB |
| 4,189,152 | 2/1980 | Raber | 273/176 AB |

*Primary Examiner*—George J. Marlo

*Attorney, Agent, or Firm*—Wenderoth, Lind & Ponack

[57] ABSTRACT

A miniature layout of a 3-course miniature golf links can afford golf players as satisfactory a feeling of golf play as experienced at a formal 9-hole golf links without necessitating a large area for construction. In a limited narrow area, three courses are arrayed in a triangular configuration. In each one of two courses among the three courses are disposed one tee position for a long course, one tee position for a middle course, one tee for a short course and a putting green, and in the other one course are disposed three tee positions for middle courses and a putting green, whereby it is made possible to play golf of 9 holes, par 36, by playing golf while going around the above-mentioned three courses either in the clockwise direction or in the anticlockwise direction. Preferably, an auto-caddie-cart system is disposed in a loop form along the inner periphery of the courses. Also, preferably a lighting installation for night play is disposed along the inner periphery of the courses.

4 Claims, 1 Drawing Sheet

3-COURSE MINIATURE GOLF LINKS

BACKGROUND OF THE INVENTION

1. Field of the Invention

The present invention relates to a 3-course miniature golf links constructed in the suburbs of a town or as incidental facilities of a resort hotel or the like.

2. Description of the Prior Art:

Because of the circumstance of an estate as well as the legal regulations in recent days, it is impossible to newly construct a golf links where golf players can experience 9-hole golf course plays in the suburbs of a town, and so, as a substitute therefore, a miniature golf links necessitating only a small area of land, which is composed of only short courses, which is composed of only putter courses, or which is composed of only several holes, is being constructed.

However, the miniature golf links composed of only short courses necessitates a considerable area for its site because it is composed of short courses at 9 locations, but from the standpoint of golf players, they cannot experience a formal 9-hole golf course, because the golf links consists of only short courses, and they cannot get a satisfactory feeling.

In the case of the miniature golf links composed of only putter courses, though a small area of the site can suffice, it is still no more than in the category of a putting exercise links, and moreover, golf players cannot get satisfactory feeling as if just having played at a golf links.

The miniature golf links composed of only several holes is also similar to the above-described respective miniature golf links.

SUMMARY OF THE INVENTION

It is therefore one object of the present invention to provide a novel miniature golf links which is free from the above-described shortcomings of the miniature golf links in the prior art.

A more specific object of the present invention is to provide a miniature golf links, which allows golf players to experience a 9-hole golf course with a minimum area for the site, and which can be constructed in the suburbs of a town where a managing efficiency is high or can be constructed as incidental facilities of a resort hotel.

According to one feature of the present invention, there is provided a 3-course miniature golf links, in which three courses are arrayed in a triangular configuration, in each one of two courses among the three courses are disposed one teeing area for a long course, one teeing area for a middle course, one teeing area for a short course and a putting green, and in the other one course are disposed three teeing area for middle courses and a putting green, whereby it is made possible to play golf of 9 holes with a par of 36 by playing golf while going round the three courses either in the clockwise direction or in the anticlockwise direction.

According to the present invention, since golf players play golf while going round the three courses, they can play golf of 9 holes in total, respectively, under different atmospheres. Moreover, according to the present invention, golf players can experience a formal 9-hole golf course with a minimum area for the site.

The above-mentioned and other objects, features and advantages of the present invention will become more apparent by reference to the following description of one preferred embodiment of the invention taken in conjunction with the accompanying drawing.

BRIEF DESCRIPTION OF THE DRAWING

In the accompanying drawing, consisting of only one sheet, is a schematic plan view showing a clockwise layout of a 3-course or 3-fairway compact golf links or golf course according to one preferred embodiment of the present invention.

DESCRIPTION OF THE PREFERRED EMBODIMENT

Figure 1:
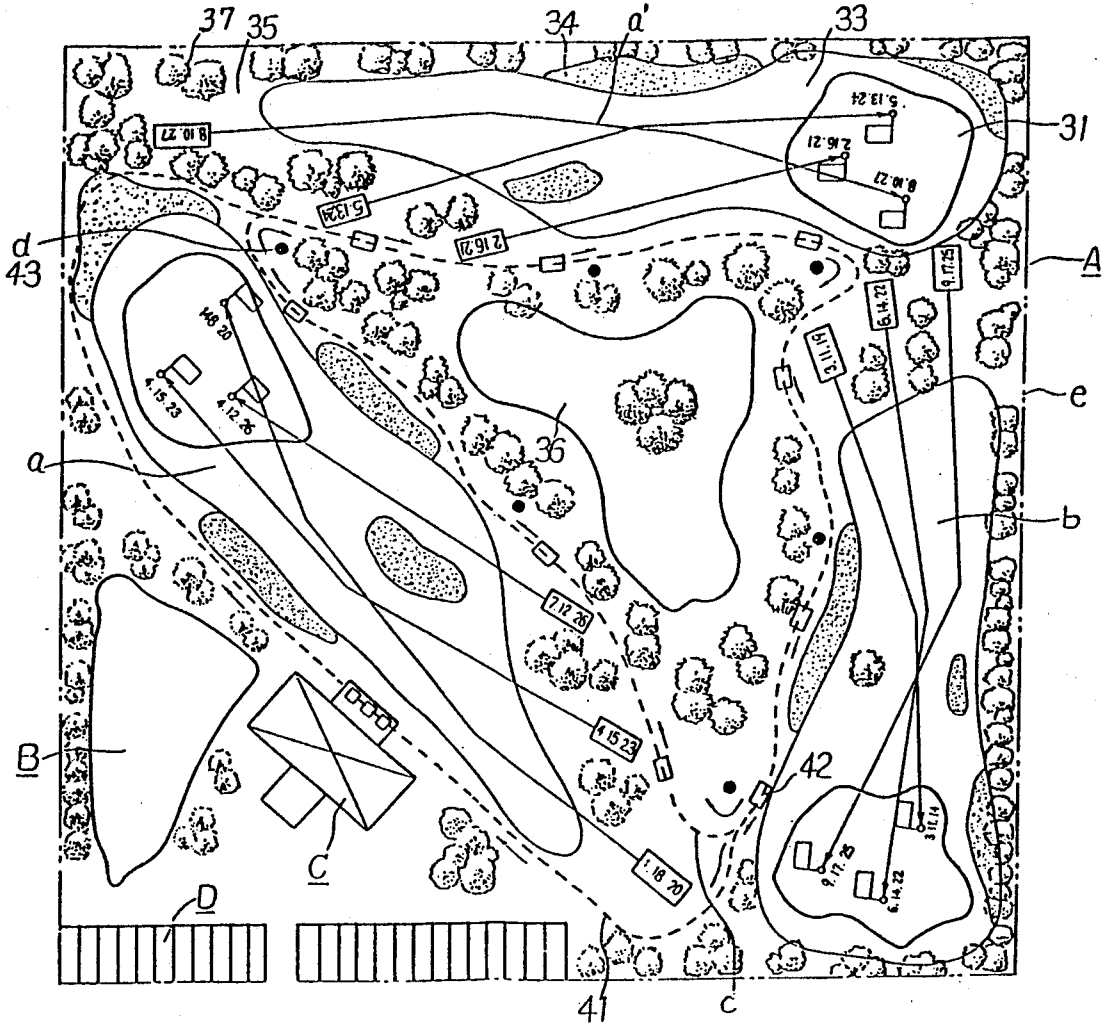

A clockwise layout of a 3-fairway compact golf course according to one preferred embodiment of the present invention is illustrated in FIG. 1. In this figure, reference character A designates a miniature golf links, character B designates a golf exercise area, character C designates a clubhouse, character D designates a parking area, characters a and a' designate first types of courses, character b designates a second type of course, character c designates an auto-caddie-cart system, character d designates a lighting installation for night play, character e designates a fence, reference numerals 1, 8, 10, 18, 20 and 27 designate teeing area for long courses, numerals 2, 7, 12, 16, 21 and 26 designate teeing areas for short courses, numerals 3, 4, 5, 6, 9, 11, 13, 14, 15, 17, 19, 22, 23, 24 and 25 designate teeing areas for middle courses, numeral 31 designates a putting green, numeral 33 designates a fairway, numeral 34 designates a bunker, numeral 35 designates rough, numeral 36 designates a pond, numeral 37 designates a tree, numeral 41 designates cart rails, numeral 42 designates carts, and numeral 43 designates an electric, light pole for night play.

The three courses a, a' and b are arrayed in a triangular configuration, among these three courses two courses a and a' each have one teeing area for a long course (LC), one teeing area for a middle course (MC), one teeing area for a short course (SC) and one putting green, disposed therein to make the number of shots amount to 12 in total. The remaining one course b has three teeing areas for middle courses (MC) and one putting green disposed therein to make the number of shots amount to 12 in total, and thereby the golf links is constructed so that play of a 9-hole 36 par course can be done with only three courses.

An auto-caddie-cart system consisting of the cart rails 41 and the carts 42 is disposed in a loop form along the inner periphery of the triangular array of the three courses a, a' and b.

Likewise, a lighting installation for night play is disposed along the inner periphery of the triangular array of the three courses a, a' and b.

36 players forming 9 groups in total form 1 circle, and 12 players forming 3 groups are allotted to each course a, a' or b and allowed to start in the respective courses.

The players in the group allotted to the course a would play and hole out while going round in the clockwise direction through 9 holes in 36 strokes, consisting of courses 1 (long), 4 (medium) and 7 (short) in the course a in 12 strokes, courses 2 (short), 5 (medium) and 8 (long) in the course a' in 12 strokes and courses 3 (medium), 6 (medium) and 9 (medium) courses in the course b in 12 strokes.

The players in the group allotted to the course a' would play and hole out while going round in the clockwise direction through 9 holes in 36 strokes, consisting of courses 10 (long), 13 (medium) and 16 (short)

in the course a ′ in 12 strokes, courses 11 (medium), 14 (medium) and 17 (medium) in the course b in 12 strokes and courses 12 (short), 15 (medium) and 18 (long) in the course a in 12 strokes. The players in the group allotted to the course b would play and hole out while going round in the clockwise direction through 9 holes in 36 strokes, consisting of courses 19 (medium), 22 (medium) and 25 (medium) in the course b in 12 strokes, courses 20 (long), 23 (medium) and 26 (short) in the course b in 12 strokes and courses 21 (short), 24 (medium) and 27 (long) in the course a′ in 12 strokes.

In the case of the illustrated miniature golf links, since a necessary play time is about 2 hours for one circle, during 8 hours of operation, 144 players of 36 groups can play. Accordingly, in contrast to the fact at most 216 players of 54 groups can play and hence a rate of operation for 3 holes amounts to 36 players of 9 groups, a rate of operation about 4 times as large as that of the conventional 18-hole golf links is realized, and the illustrated miniature golf links has a very excellent efficiency in economy. In addition, since an installation for night play is provided, it is also possible to extend the operation time.

In the case of the illustrated miniature golf links, if the number of groups that can start at the same time is chosen to be 2–3 groups for the respective courses and one circle is formed of 6–9 groups in total, then the efficiency per unit time is good and the pace of progress of the players is proper.

As will be obvious from the detailed description of one preferred embodiment above, according to the present invention, owing to the fact that three courses are arrayed in a triangular configuration, the numbers of strokes in the three courses are made the same, and players are made to start so as to go round in the clockwise direction or in the anticlockwise direction, and golf play can be made to proceed safely and efficiently without making players stay at one place and without cross-play.

Also, due to the disposal of an auto-caddie-cart system in a loop shape along the inner periphery of the triangular array of the courses, the necessary installation expense can be minimized, and caddies are unnecessary.

Furthermore, as a result of the arrangement of a lighting installation for night play along the inner periphery of the triangular array of the courses, the necessary installation expense can be minimized, and the time of business can be extended. Therefore, the efficiency of management is enhanced.

After all, according to the present invention, despite a minimum area of the site, it becomes possible to construct a 3-course miniature golf links in the suburbs of a town where an efficiency of management is excellent or as incidental installations of a resort hotel, which makes it possible to experience a formal 9-hole golf course.

While a principle of the present invention has been described above in connection to one preferred embodiment of the invention, it is intended that all matter contained in the above description and illustrated in the accompanying drawings shall be interpreted to be illustrative and not in a limiting sense.

What is claimed is:

1. A compact golf course, comprising:

three fairways arranged in a triangular configuration;

a putting green for each said fairway;

two of said fairways each having a set of three teeing areas, with each set of three teeing areas for said two fairways including a short distance teeing area, a medium distance teeing area and a long distance teeing area; and the third said fairway having a third set of three medium distance teeing areas;

wherein a total of nine said teeing areas are provided to enable the play of nine different golf holes by playing each of said three fairways three times form each of said nine teeing areas.

2. The compact golf course of claim 1, wherein each said green has three separate holes therein for each of the respective said tee positions.

3. The compact golf course of claim 1, wherein an auto-caddie-cart system is disposed in a loop along the inner periphery of said triangular configuration of said fairways.

4. The compact golf course of claim 1, wherein a lighting installation for night play is disposed along the inner periphery of said triangular configuration of said fairways.

* * * * *